US009194646B2

(12) United States Patent
Victor et al.

(10) Patent No.: US 9,194,646 B2
(45) Date of Patent: Nov. 24, 2015

(54) TOY PROJECTILE LAUNCHER APPARATUS

(71) Applicant: Hasbro, Inc., Pawtucket, RI (US)

(72) Inventors: Robert James Victor, Sunnyside, NY (US); Brian Jablonski, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 201 days.

(21) Appl. No.: 13/886,463

(22) Filed: May 3, 2013

(65) Prior Publication Data

US 2013/0239936 A1 Sep. 19, 2013

Related U.S. Application Data

(63) Continuation-in-part of application No. 12/890,689, filed on Sep. 26, 2010, now Pat. No. 8,967,130.

(51) Int. Cl.

| | |
|---|---|
| ***F41B 7/08*** | (2006.01) |
| ***F41A 19/52*** | (2006.01) |
| ***F41B 3/03*** | (2006.01) |
| ***F41B 7/00*** | (2006.01) |
| ***F41A 19/25*** | (2006.01) |

(52) U.S. Cl.

CPC . *F41B 7/08* (2013.01); *F41A 19/25* (2013.01); *F41A 19/52* (2013.01); *F41B 3/03* (2013.01); *F41B 7/003* (2013.01); *Y10T 29/49863* (2015.01)

(58) Field of Classification Search

CPC ..... F41B 3/03; F41A 19/25; F41A 19/52; A63H 27/00; A63H 27/14; A63H 29/04

See application file for complete search history.

(56) References Cited

U.S. PATENT DOCUMENTS

| | | | | |
|---|---|---|---|---|
| 1,374,757 | A * | 4/1921 | Napier | 124/26 |
| 3,224,141 | A * | 12/1965 | Borak | 446/137 |
| 3,717,136 | A * | 2/1973 | Gay | 124/21 |
| 4,059,089 | A * | 11/1977 | Lehman | 124/27 |
| 5,050,575 | A | 9/1991 | Killion | |
| 5,613,482 | A * | 3/1997 | Thai et al. | 124/16 |
| 7,673,624 | B2 * | 3/2010 | Rosella, Jr. | 124/10 |

FOREIGN PATENT DOCUMENTS

| | | | |
|---|---|---|---|
| FR | 2185933 A5 | 1/1974 | |
| GB | 2046107 A * | 11/1980 | F41B 7/08 |

OTHER PUBLICATIONS

European Patent Application No. EP 11182731.7—Communication Transmittal, European Opinion, and Search Report dated Sep. 13, 2013.

* cited by examiner

*Primary Examiner* — John E Simms, Jr.
(74) *Attorney, Agent, or Firm* — Perry Hoffman

(57) ABSTRACT

A toy launch apparatus for projectiles having a soft exterior and an open bottom with a bordering strong inner wall. The projectile's open bottom is positioned atop a slot, with respect to a launch deck and a carriage in a housing assembly. A cocking assembly includes a pivotal launch arm and a launch spring connected to the carriage movable with an engaged slide, a slide link and carriage lock, which are cocked when a user pulls the slide rearward. At a first rearward position of the slide the carrier is restrained in a cocked configuration. On the way to a second rearward position of the slide, the slide, slide link and carriage lock disengage from the carriage, launch arm and launch spring. When the carriage and launch arm are triggered, the launch spring releases and the launch arm impacts the inner wall of the projectile for discharge.

18 Claims, 17 Drawing Sheets

TOY PROJECTILE LAUNCHER APPARATUS

PRIORITY CROSS-REFERENCE TO RELATED APPLICATION

This application is a continuation-in-part and claims priority pursuant to 35 U.S.C. 119(e) from U.S. patent application Ser. No. 12/890,689, filed on Sep. 26, 2010, which is expressly incorporated herein by reference.

FIELD OF THE INVENTION

The present invention relates generally to a toy launch apparatus and projectile, and, more particularly, to a toy launch apparatus having a pivotal launch arm and a circular projectile having a soft exterior, an open bottom and a robust hard inner wall bordering the open bottom, the launch arm causing discharge of the projectile by impacting the inner wall through the open bottom.

BACKGROUND OF THE INVENTION

Toys and other devices that discharge disc-like objects have been designed in the past with various housing and internal elements. These devices are often difficult to use and/or are dangerous for children, and/or are too expensive, complicated or insufficiently robust.

Launching devices, toy and otherwise, are well known and are disclosed in several existing patents. By way of example, Napier patented a launching device in 1920 and again in 1921, U.S. Pat. No. 1,353,663 for a "Target Throwing Device" and U.S. Pat. No. 1,374,757 for a "Catapult." These patents purport to disclose a launching device for clay pigeon targets and include a slanted platform with a guide way in the platform, a guide rail to one side of the platform and a roller for accelerating the clay pigeon. Friction material is added to the guide rail and to the roller to "give it the (clay pigeon) the desired action as it leaves said platform." U.S. Pat. No. 4,016,854 for a "Spring Type Bottle Cap Pistol" issued in early 1977 to Lehman, purports to disclose a pistol to propel and spin a bottle cap by positioning a spring connected to a plunger in a lower longitudinally directed chamber, attaching a hammer to the plunger, the hammer extending through a slot in a upper longitudinally directed chamber where the bottle cap is loaded. The hammer is located off-center from the bottle cap so that when a trigger is rotated, the plunger is released to accelerate the hammer and bottle cap along the upper chamber to discharge the bottle cap while also inducing a spin in the cap. A restraining pin extends through a slot to abut an interior surface wall of the bottle cap to prevent the bottle cap from moving along the upper chamber until the trigger is depressed at which time the pin moves out of the way. Loading of a bottle cap is from above the pistol through a sliding cover. Another patent issued to Lehman later in 1977, U.S. Pat. No. 4,059,089 for a "Flying Saucer Launching Pistol" purports to disclose a pistol very similar to that disclosed in his earlier patent but with a pair of ramps in the firing chamber tapered so as to center different diameter discs when each is loaded. U.S. Pat. No. 4,170,215 for a "Disk Toy And Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs, the spring propels the disk away from the launcher.

Another U.S. Pat. No. 4,248,202 for a "Disc Launcher" issued in 1981 to Jaworski and Breslow, purports to disclose a mechanical launcher having a circular casing, a disc magazine for feeding discs by gravity, an actuating arm movable between a loading position and a firing position, a spring and a rubber band biased trigger. In the loading position the actuating arm receives a soft round disc in front of a curved edge portion. A user rotates the actuating arm and the edge portion to a firing position, the actuating arm preventing any more discs falling from the magazine, while moving a free arm of the spring loads the spring. All the while a launching slot is blocked. The user then returns the actuating arm to the loading position. When the user pulls the trigger, the free arm of the loaded spring contacts the outer peripheral portion of the disc to eccentrically propel the disc through the launching slot and away from the launcher.

U.S. Pat. No. 4,659,320 for a "Toy Vehicle With Disc Launching Apparatus And Disks" issued in 1987 to Rich et al, and purports to disclose a toy vehicle carrying an inclined track for storing multiple disks and a spring biased catapult lever. When a user moves the catapult lever to load the spring and then releases the catapult lever, a peripheral edge of the lever engages a spindle of a disk causing the disk to spin and eject from the vehicle. The disk moves away from the vehicle along the surface on which the vehicle is positioned. (It is noted that the spellings used for "disc" and "disk" are adopted from spellings used by the referenced patents, and in the case of U.S. Pat. No. 4,659,320 both spellings are used.) U.S. Pat. Nos. 5,471,967 and 5,611,322 issue to Matsuzaki in 1995 and 1997, respectively, for a "Disc Discharging Toy" purports to disclose motor operated spinning wheels for imparting energy to a discharging disc. U.S. Pat. No. 5,996,564 for a "Disc Discharge Device" issued in 1999 to Kotowski, purports to disclose a disc-discharging toy having a magazine for stacking resilient discs and a motor driven roller mounted in a position such that the roller's axis of rotation is perpendicular to the axis of rotation of a discharging disc. When the motor is activated and a disc is moves forward to the spinning roller, a bumper places the disc in position to make correct contact between the disc and the roller prior to the disc being discharged. In 2001, U.S. Pat. No. 6,224,457 for a "Knock-down Style Safety Disk-Shooting Toy" issued to Wu, purports to be another example of a motor driven disk-discharging toy, although this device includes light and sound effects.

In 2004, U.S. Pat. No. 6,733,356 for a "Flying-Object Launching Toy Gun" issued to Lee, and purports to disclose a toy gun for launching a propeller-like device from the gun using springs to provide launch energy and a rack and pinion to cause the propeller-like device to spin as it is launched. Lastly, U.S. Pat. No. 7,673,624 issued in 2010 for a "Disk Shooting Toy" issued in 2010 to Rosella Jr., purports to disclose a toy for shooting disks using a spring plunger and a spin member, the distal end of a curved resilient arm.

These patents and devices are of some interest, however, they do not disclose or illustrate a marketable toy item of superior play value.

SUMMARY OF THE INVENTION

In accordance with the present invention, an advantageous method and apparatus are provided in the form of a toy launcher and projectile where the projectile has an open bottom and a strong wall bordering the open bottom. The projectile may include a soft foam exterior covering the wall. The toy launcher is easily operated, even by young children, and requires a projectile to be inserted into the launcher, a slide to be moved rearward to cock a launch spring, and a launch arm to be pivoted. The launch apparatus and projectile also have the advantages of being relatively simple, easy and fun to use, safe, relatively inexpensive, compact and yet, structurally robust.

Briefly summarized, the invention relates to a toy launch apparatus and projectile including a housing assembly, a launch deck mounted to the housing assembly for receiving a projectile, the launch deck having a slot, a projectile for being supported on the launch deck over the slot, the projectile having an open bottom, a soft exterior and a hard inner wall bordering the open bottom, a cocking assembly mounted to the housing assembly, the cocking assembly including a launch arm movable in the slot, and a launch spring connected to the launch arm, the launch arm being movable to engage the inner wall of the projectile, and a trigger mounted to the housing assembly and connected to the launch spring to enable the launch spring to be released from a tensioned position and cause the launch arm to strike the robust inner wall of the projectile through the open bottom.

The invention also relates to a method for making a toy launch apparatus and projectile including forming a housing assembly, forming a projectile having an open bottom, a soft exterior and a robust inner wall bordering the open bottom, forming a launch deck in the housing assembly, the launch deck including a slot for receiving a projectile wherein the slot is beneath the open bottom of the projectile, mounting a cocking assembly to the housing assembly, the cocking assembly including a pivotal launch arm and a launch spring, connecting the launch spring to the housing assembly and to the launch arm, the launch spring being movable to a tensioned position, connecting a structure to the housing assembly to maintain the launch spring in the tensioned position, mounting the launch arm to rotate through the slot between a lowered position and a raised position and through the open bottom of the projectile to impact the inner wall of the projectile, and connecting a movable trigger to the housing assembly to cause the structure to release the launch arm.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

Figure 1:
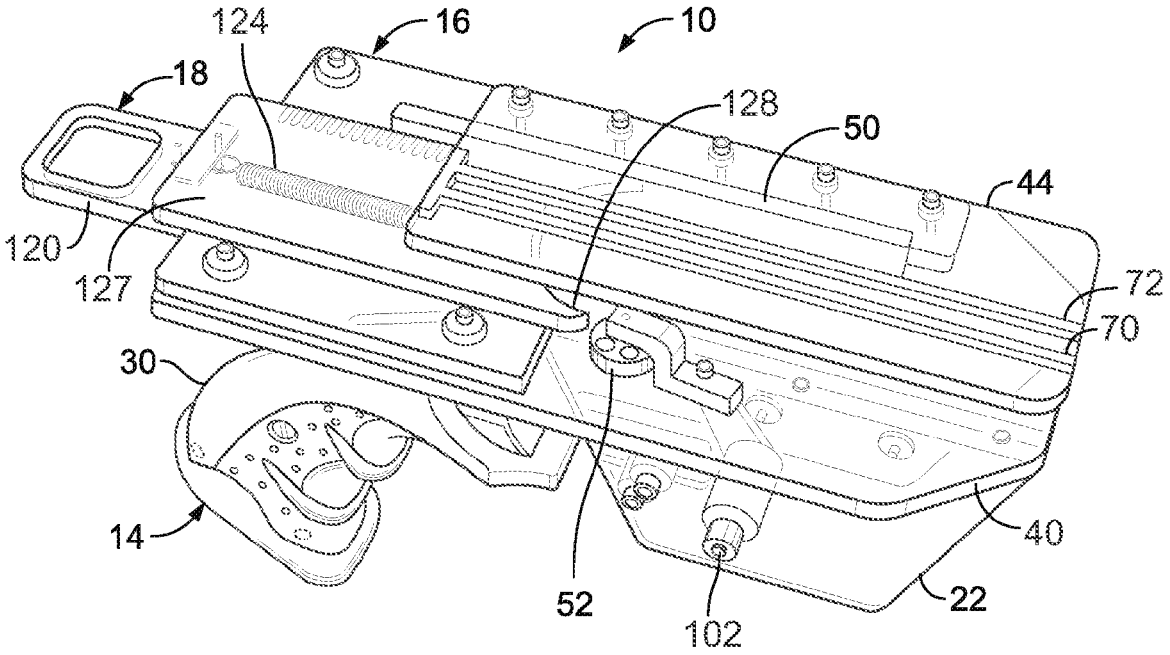
FIG. 1 is a downward looking isometric view of a preferred embodiment of the present invention in the form of a toy projectile launch apparatus.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring now to FIGS. 1-5, there is shown an embodiment of the invention in the form of a toy projectile launcher apparatus 10 for discharging circular projectiles provided in the form of an aerodynamic flying disc or a toy projectile having a soft exterior and a more robust interior, somewhat similar to discs commonly referred to as Frisbees, one such projectile 12 being shown in FIGS. 6, 7 and 9-12. The toy projectile is structured to be discharged from a toy launcher apparatus with discharge energy imparted to the toy projectile through a brief, but sharp impact at a relatively small contact area at the toy projectile generating good flight characteristics and distance. The toy launcher apparatus includes a housing assembly 14, a platform assembly 16, a cocking assembly 18, a trigger 20 and side support panels 22, 24. The platform assembly, part of the cocking assembly, and the support panels are formed of clear plastic to better illustrate internal mechanisms of the launcher apparatus 10. In the alternative, non-clear plastic and different shapes may be used if found desirable as exemplified by the embodiment shown in FIGS. 14 and 15.

The housing assembly 14 includes a gun-like grip 30 to enable a user to hold the toy projectile launcher apparatus while easily cocking the apparatus, and loading, positioning and discharging the projectile. The housing assembly 14 acts as a base for the platform assembly 16, the cocking assembly 18, the trigger 20 and the side support panels 22 and 24. The trigger 20 is located in the conventional location for ease of use.

The platform assembly 16 includes a horizontally disposed lower panel or launch deck 40 having a top surface 42, and an upper panel or disc ceiling 44 positioned parallel to, but spaced from the lower panel 40 at a predetermined distance approximately equal to the height of the projectile 12, and having a bottom surface 46. The platform assembly also includes a longitudinal guide wall 50 mounted to the launch deck 40, a positioning wheel or limit structure 52 also mounted to the launch deck 40, and support rollers 54, 56, 58 connected to the support panels 22, 24 for supporting part of the cocking assembly. Connected to and depending from the launch deck 40 are the side support panels 22, 24. The launch deck 40 includes a longitudinal slot 60, running parallel to the guide wall 50, with the longitudinal slot 60 being positioned in the launch deck out of alignment with a center point of the projectile 12 as will be explained in more detail below. The bottom surface 46 of the upper panel 44 and the top surface 42 of the launch deck 40 each include friction reducing guide rails, a pair of guide rails 70, 72, FIG. 4, on the bottom surface 46 and three guide rails 74, 76, 78 on the top surface 42. The rails provide low friction guides for positioning the projectile and for blocking projectiles of the wrong size. The rails also prevent the projectile from moving upward in response to a discharge force.

Figure 6:
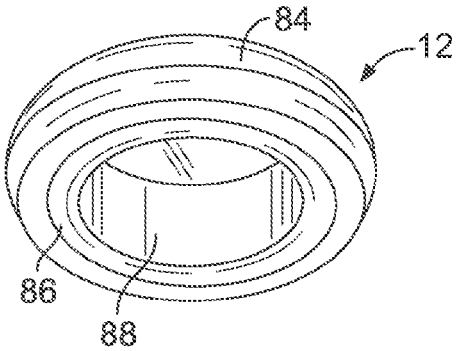
FIG. 6 is an upward looking isometric view of a toy projectile of the type that may be discharged by the toy launch apparatus shown in FIGS. 1-5.
Figure 7:
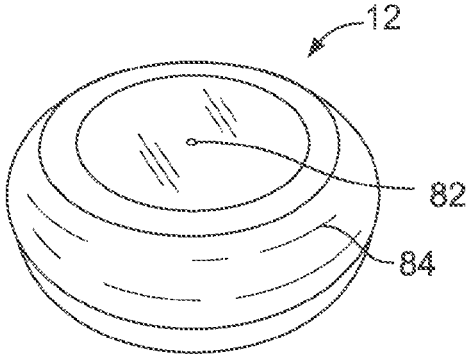
FIG. 7 is a downward looking isometric view of the toy projectile shown in FIG. 6.

The circular projectile 12, FIGS. 6 and 7, has a circular plan view configuration, with a center point 82, FIG. 7, an outer covering 84 of soft material, such as that sold under the brand NERF™, and an inner core 86 of a more robust material, such as hard plastic, all as disclosed in a companion patent application (application Ser. No. 12/890,686). The outer covering 84 is generally donut shaped with an open center and the inner core 86 is generally cup shaped and positioned in the open center so that the top of the projectile is closed, as shown in FIG. 7, and the bottom is opened, as shown in FIG. 6. Bordering the open bottom is an annular inner wall 88 of the inner core 86. Aerodynamically the projectile 12 acts similarly to a Frisbee in that the projectile has, when launched, a direction of flight or travel as well as a rotational spin. As will be explained in more detail below, when launched, the "off center" location of the launcher slot 60 relative to the center point 82 of the projectile allows the projectile to be engaged by a launch arm so such that a component of force is directed parallel to the slot in the direction of projectile travel, and a component force acts perpendicular to the slot to enable a spin to be engendered when the projectile is launched.

Figure 2:
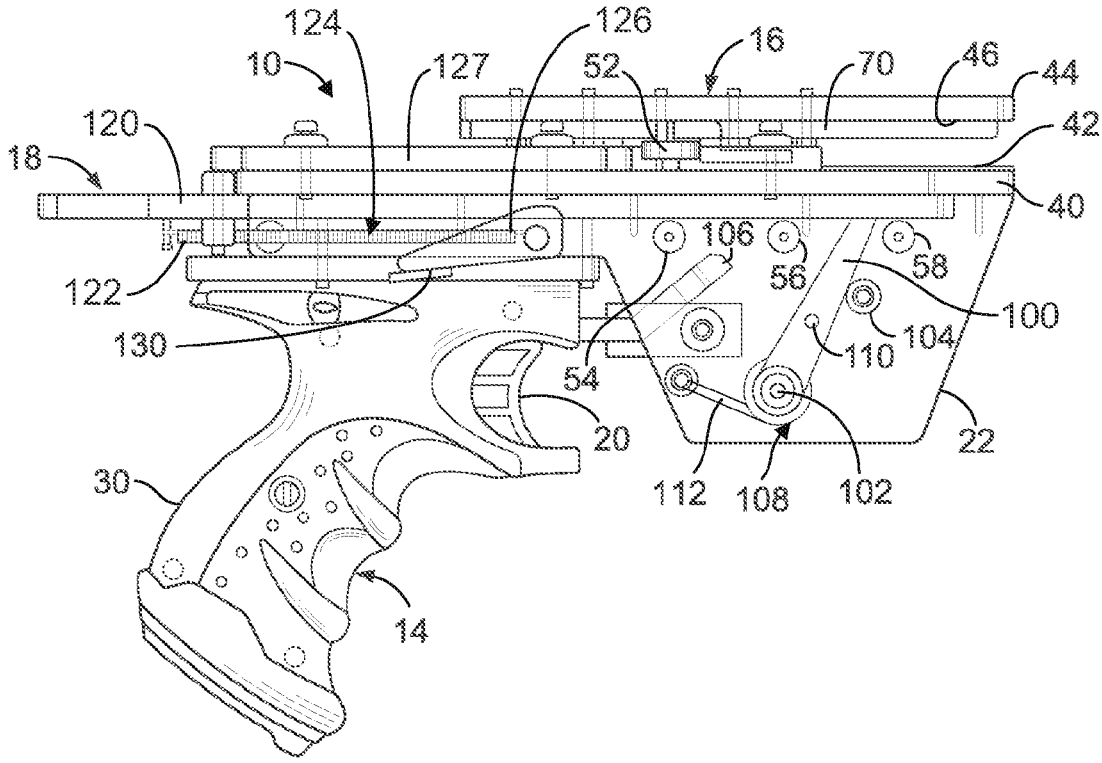
FIG. 2 is a right side elevation view of the toy projectile launch apparatus shown in FIG. 1.
Figure 3:
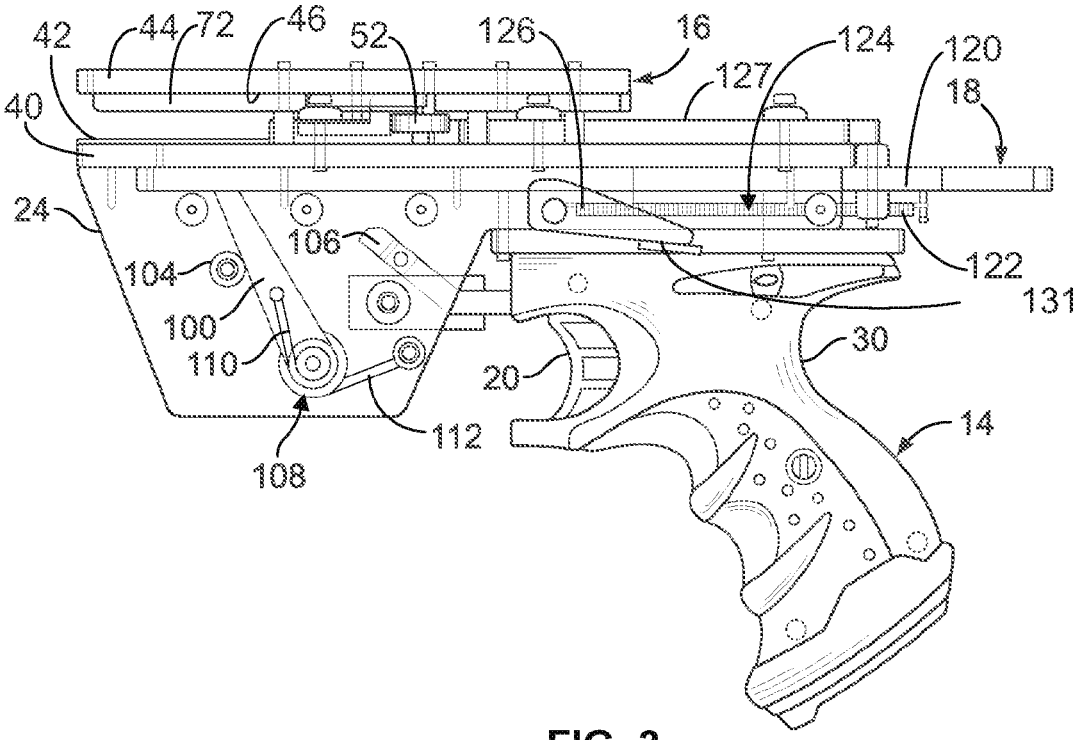
FIG. 3 is a left side elevation view of the toy projectile launch apparatus shown in FIGS. 1 and 2.
Figure 11:
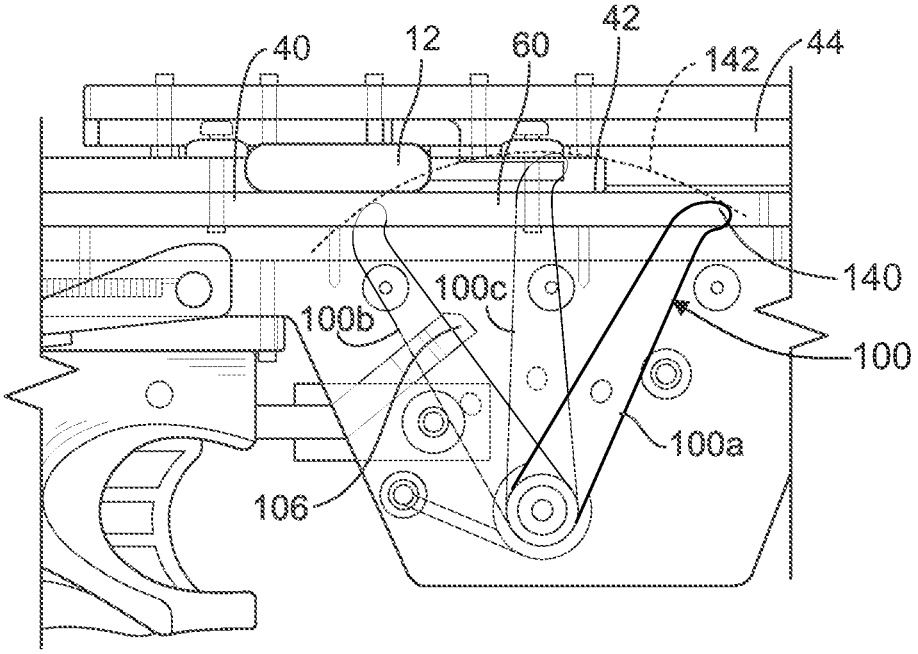
FIG. 11 is an enlarged, partial diagrammatic elevation view, similar to the view shown in FIG. 2, but with a launch arm moving between an uncocked position and a cocked position.

The cocking assembly 18 includes a launch arm 100, FIGS. 2, 3 and 11, that is connected to the side panels 22, 24 at a pivot 102 so that the launch arm is rotatable about the pivot 102 between two positions, a first or uncocked forward position shown in FIGS. 2 and 11 adjacent a cushioned bumper 104, and designated 100*a*, in FIG. 11, and a second or cocked rearward position also shown in FIG. 11, in dotted line and designated 100*b*, where the launch arm is captured by a catch structure 106. An intermediate position of the launch arm is also shown in dotted line in FIG. 11, and designated 100*c*, between the forward and rearward positions. The cocking assembly 18 also includes a torsion spring 108 mounted to the pivot 102 and to the support panels 22, 24 for causing the launch arm 100 to snap from the rearward cocked position to the forward position when the user squeezes the trigger 20. One arm 110 of the spring is connected to the launch arm 100 and is movable with the launch arm, and a second arm 112 of the spring is fixed to the support panels. When the launch arm 100 is moved rearward to the cocked position, the torsion spring 108 is loaded, and when released, provides a launching force or energy to the launch arm, and from the launch arm to the projectile, to cause discharge of the projectile.

The cocking assembly includes, in addition, a sliding structure or cocking slide 120 mounted beneath the lower panel or launch deck 40 and connected to the launch arm 100. The cocking slide 120 may be moved by the user from a first, at rest position shown in FIGS. 1-3 and 5, and a second, cocking position shown in FIG. 8. Attached to the cocking slide 120 is one end 122 of a slide spring 124 with the other end 126 connected to one or both of the side panels 22, 24. Movable with the cocking slide is a projectile carriage 127 that includes a projectile receptacle 128 to receive a projectile as shown in FIG. 9. Pulling the cocking slide 120 to the second position causes the slide spring 124 to stretch and create a biasing force to return the cocking slide and a loaded projectile carriage to a predetermined projectile discharge position, as shown in FIG. 10, when the slide and the carriage are released by the user. In the second position the cocking slide engages a ramp that captures and maintains the cocking slide in the rearward position until the user causes release. Simultaneously, when the cocking slide 120 is pulled rearward to the cocked position, the connected launch arm 100 is rotated to its second, cocked position where the catch structure 106 captures the launch arm 100, as shown in FIG. 11, until released by a user squeezing the trigger 20.

In addition to the launch arm 100, the catch structure 106, the cocking slide 120, the projectile carriage 127, and the slide spring 124, the cocking assembly includes release levers 130, 131, one lever on each side of the launcher apparatus as shown in FIGS. 2 and 3. The cocking slide 120 is connected to the release levers 130, 131 so that when either lever is activated, the projectile carriage 127 with the loaded projectile 12 and the slide 120 are caused to snap forward to the discharge position where the projectile is positioned against the guide wall 50 and the positioning wheel 52, as shown in FIG. 10.

The launch arm 100 includes a distal or extended end portion 140, FIG. 11, shaped like a rounded hammer, which is movable in an arc 142 shown in dotted lines as the launch arm travels between the uncocked forward position shown in solid lines and labeled 100*a*, and the cocked rearward position of the launch arm shown in phantom lines and labeled 100*b*, where the launch arm 100 is captured by the catch structure 106. An intermediate position of the launch arm 100 is shown in FIG. 11 and labeled 100*c*, between the forward and rearward positions. The vertical position of the launch arm 100*c* represents the most extended position of the launch arm above the top surface 42 of the bottom panel or launch deck 40. The movement of the launch arm end portion 140 is located in the slot 60 of the launch deck 40 and is represented by the arc 142. The arm end portion 140 extends below the top surface 42 of the launch deck 40 at opposite end portions of the arc when the launch arm is in the uncocked and cocked positions as represented by the launch arms designated 100*a* and 100*b*, such that no intersection with the projectile is possible. In the middle portion of the arc (exemplified by the intermediate position of the launch arm, designated 100*c*) the launch arm is above the top surface 42 of the launch deck 40 and contact with the projectile will take place.

When the launch arm end portion 140 moves rapidly above the top surface 42 of the launch deck 40, engagement is made between the launch arm 100 and the toy projectile annular inner wall 88 and energy is transferred from the launch arm 100 to the toy projectile 12 to accelerate the toy projectile between the rails 70, 72, 74, 76, 78 in the upper and lower panels 40, 44. Because the slot 60 in the launch deck 40 is misaligned relative to the center point 82 of the toy projectile (shown off center in an exaggerated fashion in FIG. 12), the impact force of the launch arm includes a main component of force 150, FIG. 12, directed parallel to the direction of travel of the projectile along the longitudinal axis of the toy launcher apparatus and parallel to the guide wall 50 and the slot 60, and a secondary component of force 152 directed normal to the direction of travel.

Figure 4:
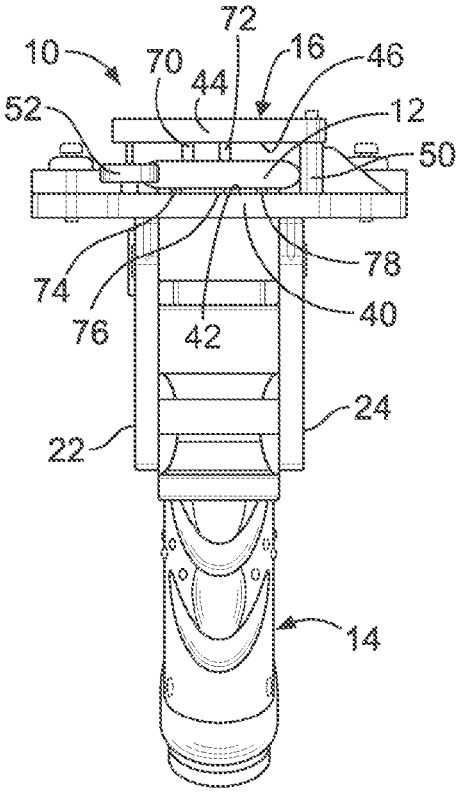
FIG. 4 is a front elevation view of the toy projectile launch apparatus shown in FIGS. 1-3 with a loaded projectile.
Figure 5:
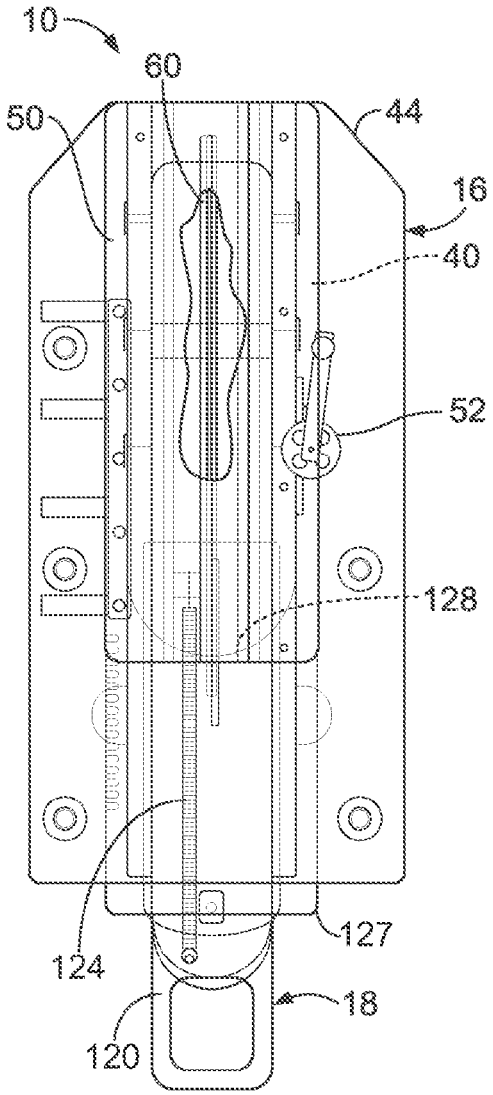
FIG. 5 is a top plan view, partially broken away, of the toy projectile launch apparatus shown in FIGS. 1-3.
Figure 8:
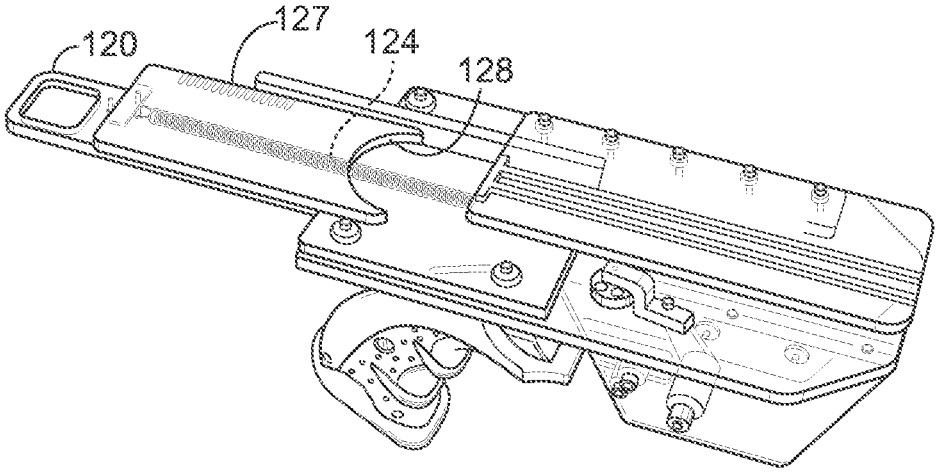
FIG. 8 is a reduced downward looking isometric view of the toy projectile launch apparatus illustrated in FIGS. 1-5, but in a cocked position.
Figure 9:
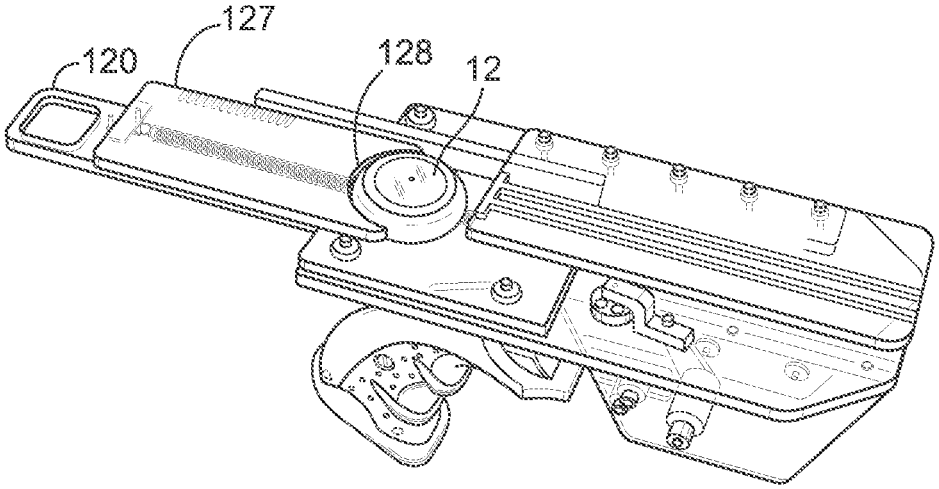
FIG. 9 is a downward looking isometric view of the toy projectile launch apparatus illustrated in FIG. 8, but with a toy projectile in a loaded position.
Figure 10:
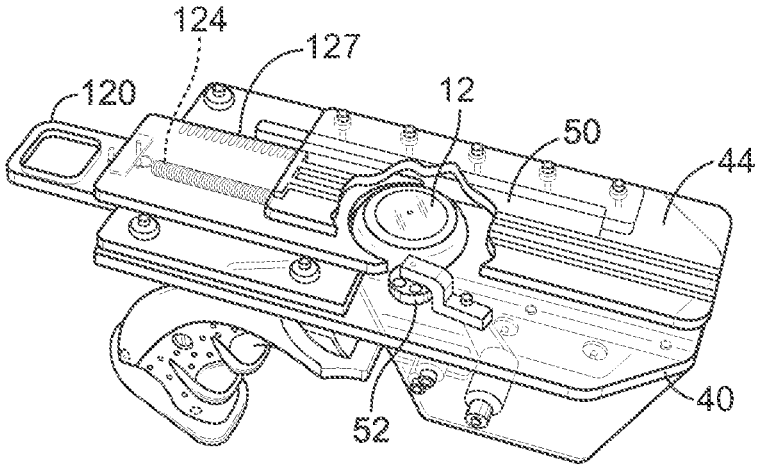
FIG. 10 is a downward looking isometric view of the toy projectile launch apparatus as illustrated in FIGS. 8 and 9, but partially broken away and with the projectile in position for discharge.
Figure 12:
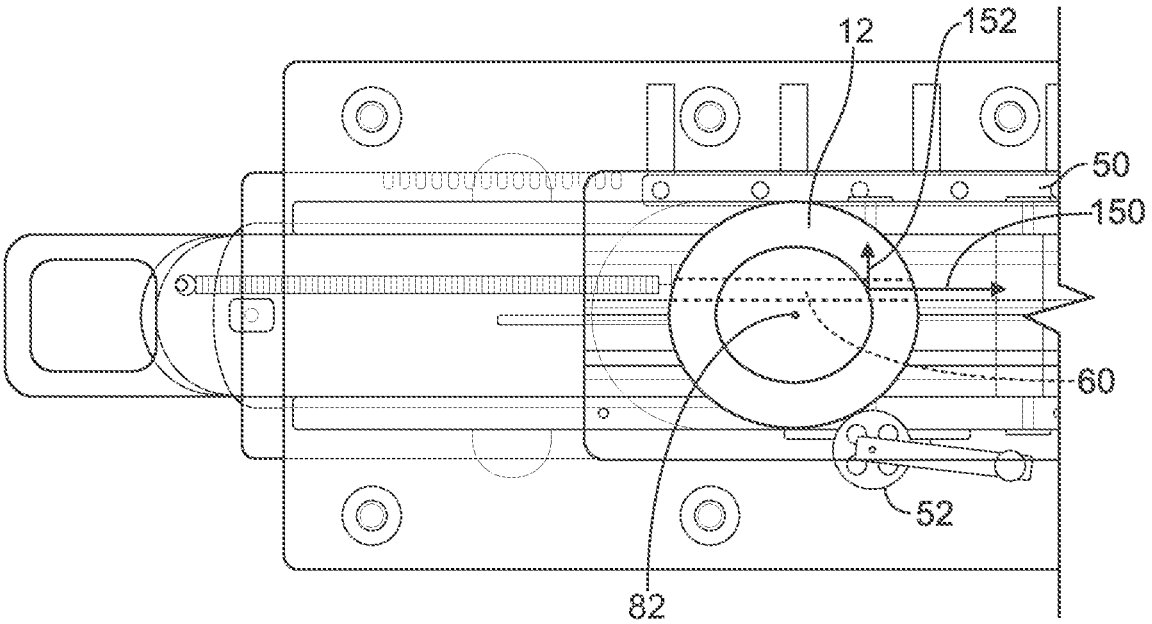
FIG. 12 is an enlarged, partial diagrammatic top plan view, similar to the view shown in FIG. 5, but illustrating force components acting on a toy projectile caused by an impact of the launch arm.

Referring now to FIGS. 8-10, cocking, loading and positioning of the toy projectile is illustrated. In FIG. 8, the cocking slide 120 is illustrated after being pulled rearward by the user to tension the torsion spring 108 and the slide spring 124. In FIG. 9, the toy projectile 12 has been loaded in the projectile receptacle 128. After release, the lever 130 is activated, and the slide spring 124 rapidly moves the cocking slide 120, the carriage 127 and the loaded toy projectile into a discharge position illustrated in FIG. 10. In the discharge position the toy projectile 12 has moved forward and bears against the guide wall 50 on one side and against the positioning wheel 52 on the opposite side, as illustrated in FIGS. 4, 10 and 12. A combination of the toy projectile bearing against the guide wall 50 caused by the force component 152 and the position of the wheel 52, creates a friction force and causes, upon discharge, the projectile to spin and thereby improve flight characteristics. It is noted that at the start of discharge the toy projectile must "squeeze" past the wheel 52. The squeeze insures that the projectile 12 will bear against the guide wall 50 inducing friction and causing the desired spin.

It is noted that throughout this disclosure, words such as "forward", "rearward", "upper", "lower", "top", "bottom", "front", "rear", "above" and "below", as well as like terms, refer to portions of the toy launcher apparatus as they are viewed in the drawings relative to other portions or in relationship to the positions of the apparatus as it will typically be held and moved during play when operated by a user.

The trigger 20 is mounted to the housing assembly 12, is spring loaded, and is connected to the catch structure 106. When pulled by the user after the user has cocked the toy launcher apparatus, the trigger moves the catch structure sufficiently to cause the launch arm 100 to be released, allowing the launch arm to rotate rapidly under the influence of the torsion spring 108 and impact upon the toy projectile as best illustrated in FIG. 11.

Figure 14:
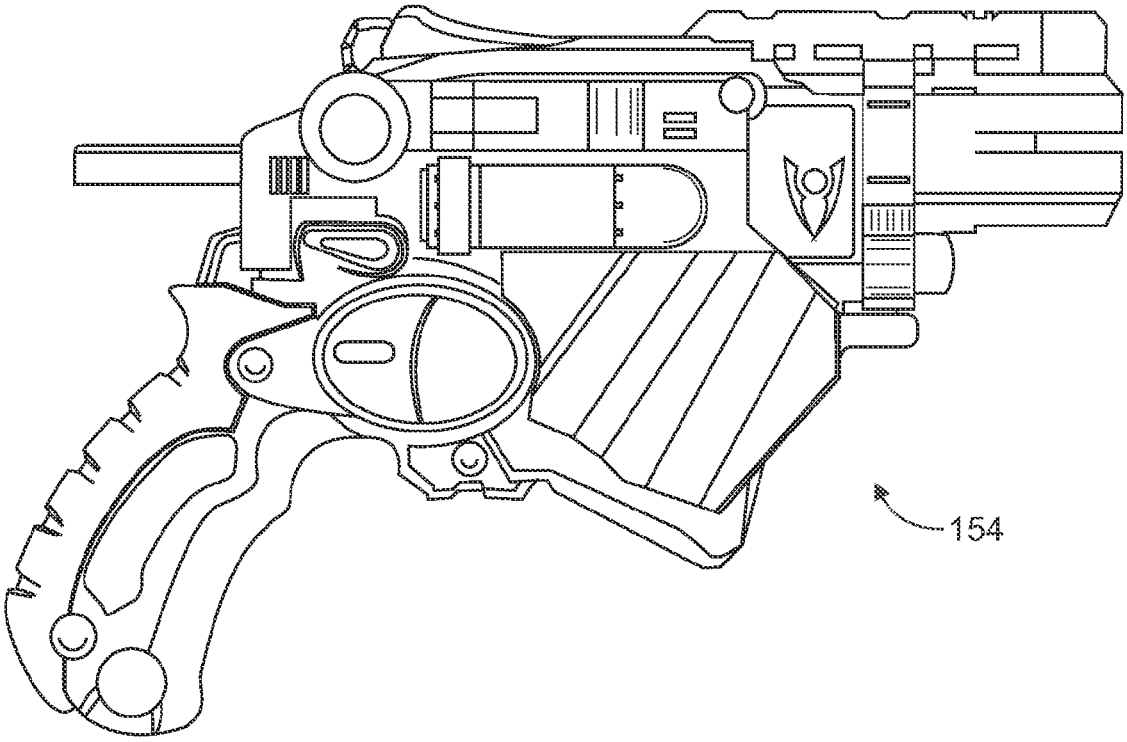
FIG. 14 is a right side elevation of another preferred embodiment of the present invention illustrating a different outer configuration from that shown in FIGS. 1-5.

The toy launcher apparatus may include, in the alternative, a projectile magazine, a cartridge, a cassette or a canister loaded with multiple projectiles to load projectiles into the receptacle. Also in the alternative, the launch arm may have a peripheral notch that a pivoting catch structure may engage to capture the launch arm in a cocked position. Another alternative may dispense with the cocking slide moving the launch arm. Instead, a cocking lever may be used or a user may directly retract the launch arm with his/her hand to its cocked position. The housing assembly may have a different design and the platform assembly may be covered or modeled after a real weapon and/or have indicia of a popular merchandising concept. One such variation toy launcher apparatus 154 is shown in FIG. 14. Also, it should be noted that the various structures described above which have been grouped as part of assemblies, may be treated individually without regard to an "assembly", or the structures may be grouped in smaller assemblies or subassemblies. The use of assemblies here is strictly for convenience and clarity.

In operation, the toy projectile launcher apparatus is held by one hand of a user using the pistol grip. The cocking slide is gripped with the other hand and pulled rearward until both the launch arm and the cocking slide are captured in their rearward positions. At the same time the carriage with the projectile receptacle, being connected to the cocking slide, is also moved rearward to expose the receptacle and allow a user to insert a circular projectile. Thereafter, one of the release levers may be moved downward to release the slide and the carriage so as to have them move forward under the influence of the stretched slide spring. This forward movement properly locates the loaded projectile in a forward position against both the positioning wheel and the guide wall, and places the projectile in position to be engaged by the launch arm once the user pulls the trigger. Once the launch arm is released and moves along the arc, the loaded projectile is impacted to cause the projectile to be discharged with a spin.

Figure 13:
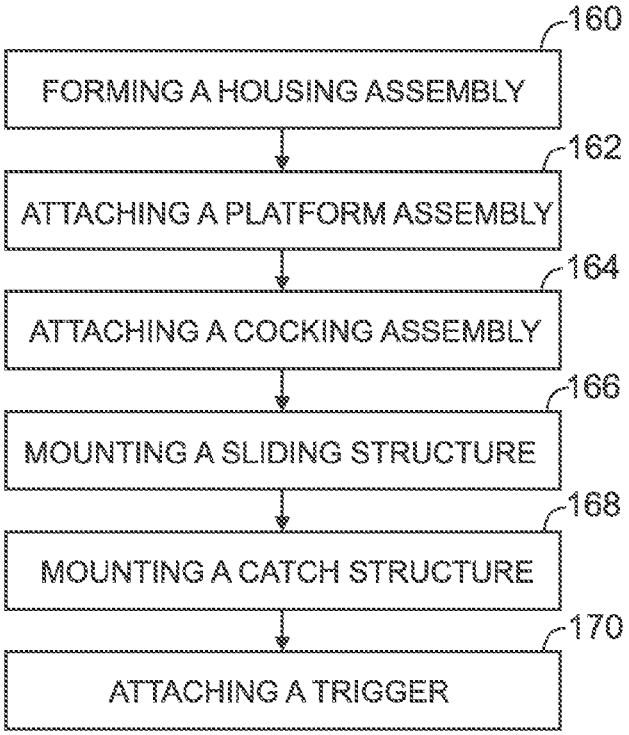
FIG. 13 is a flow diagram for a method of manufacturing the toy projectile launch apparatus illustrated in FIGS. 1-5.

The present invention also includes a method for manufacturing a toy launcher apparatus capable of discharging circular projectiles, the steps including forming a housing assembly 160, FIG. 13, attaching a platform assembly 162 to the housing assembly, the platform assembly including a panel with a slot positioned to be spaced away from alignment with a center point of a loaded circular projectile, attaching a cocking assembly 164 to the platform assembly, the cocking assembly including a launching spring, a launch arm, and a carriage, the launch arm being connected to the torsion spring, the launch arm being movable in the slot when passing between a first uncocked position and a second cocked positions, mounting a sliding structure 166 and a slide spring, the sliding structure being connected to the launch arm for moving the launch arm from the first uncocked position, mounting the catch structure 168 for engaging the launch arm to maintain the launch arm in the cocked position, and a release lever being connected to the sliding structure for causing the sliding structure and the carriage to return to an uncocked position, and attaching a trigger 170 to the housing assembly, the trigger being connected to the catch structure to enable the catch structure to release the launch arm allowing the launch arm to snap back to the first uncocked position.

Figure 15:
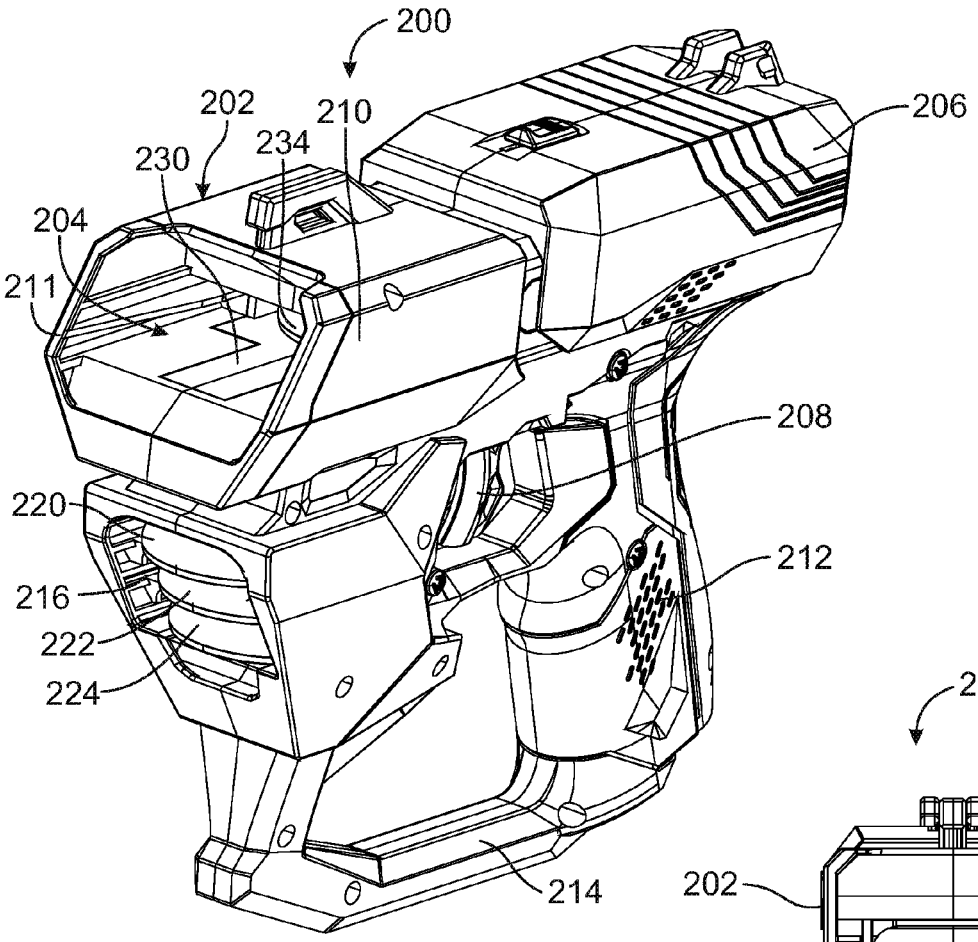
FIG. 15 is an isometric view of another preferred embodiment of the present invention in the form of a stylized toy launch apparatus and projectiles.
Figure 16:
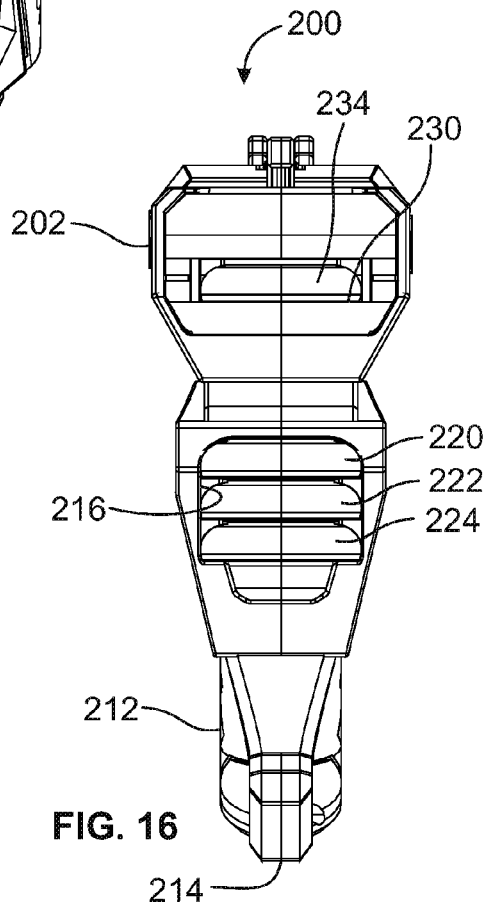
FIG. 16 is a front elevation view of the launch apparatus and projectiles shown in FIG. 15.
Figure 17:
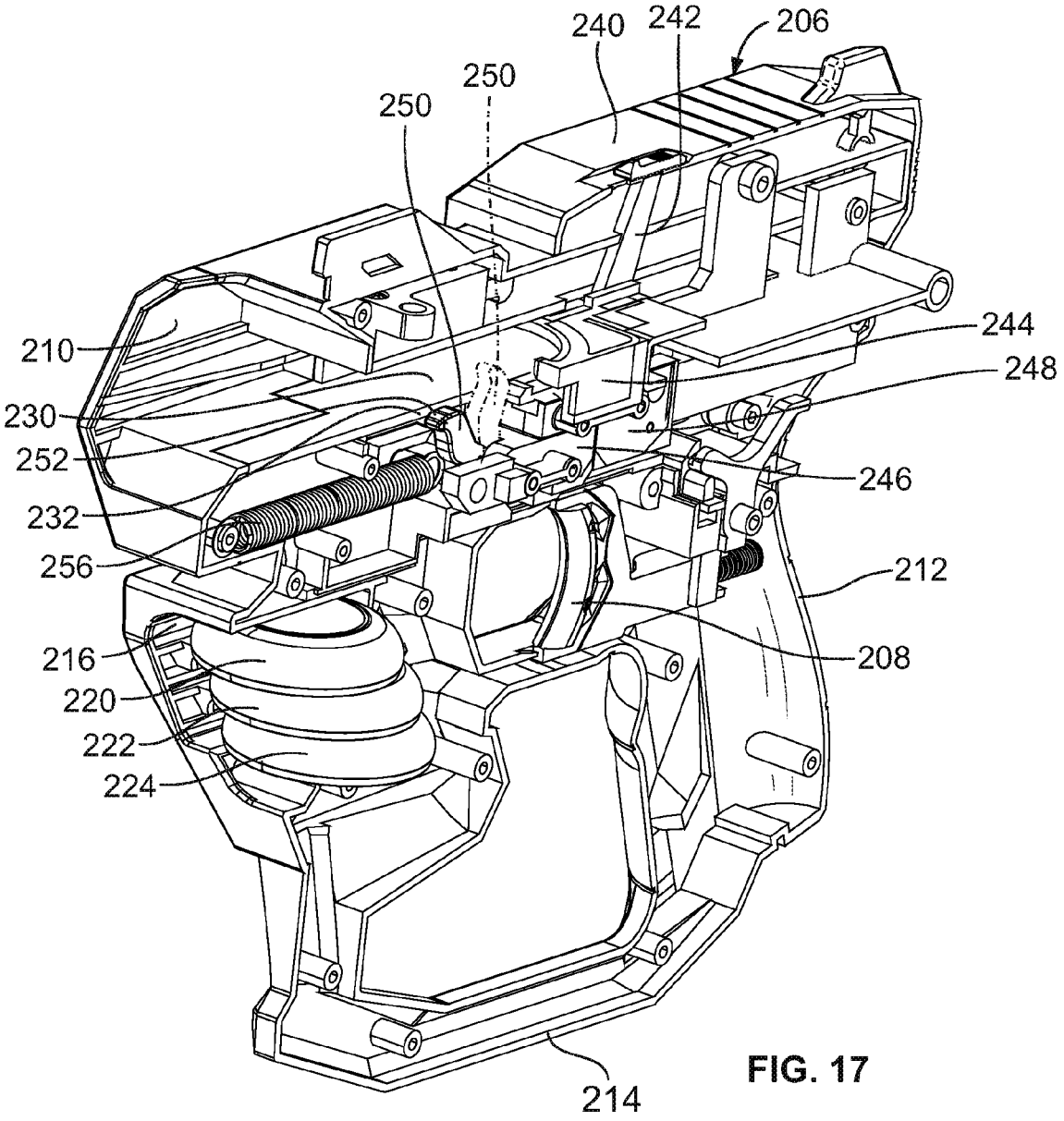
FIG. 17 is an isometric view of the launch apparatus and projectiles shown in FIGS. 15 and 16, but without a loaded projectile and with one side of a housing assembly removed.

Referring now to FIGS. 15-17, there is shown yet another, more highly styled launch apparatus 200 that includes a housing assembly 202, a platform assembly 204, a cocking assembly 206 and a trigger assembly 208. The housing assembly 202 of the launch apparatus 200 includes a barrel portion 210, a muzzle 211, a grip portion 212, a bridge portion 214 and a projectile storage bin 216, illustrating the storage of three projectiles 220, 222, 224. The platform assembly 204 includes a launch deck 230 with a longitudinal slot 232, FIG. 17, and another projectile 234, is shown on the launch deck 230 loaded in the launch apparatus 200.

Figure 18:
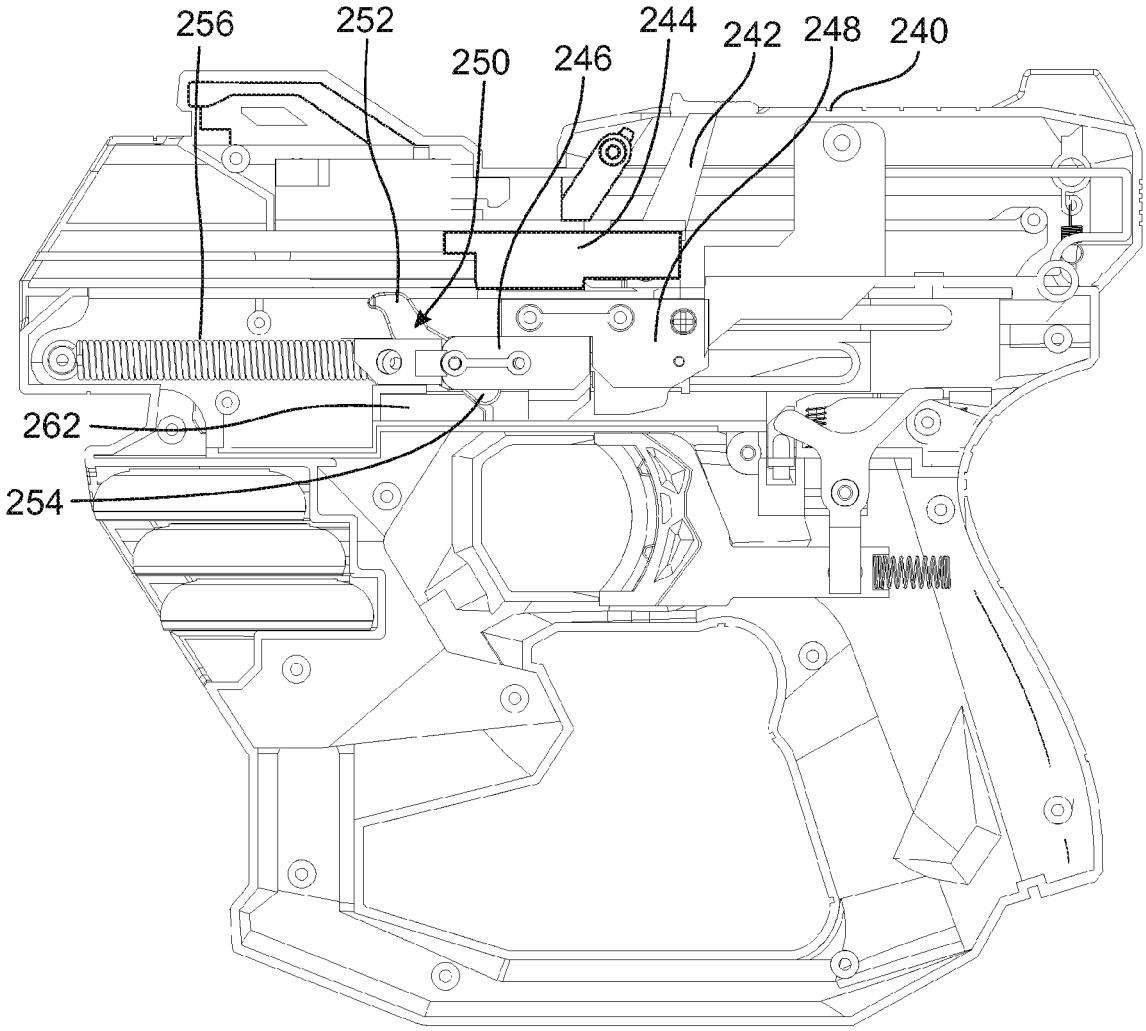
FIG. 18 is a side elevation view of the launch apparatus shown in FIG. 17, without a loaded projectile.

The cocking assembly 206, FIG. 17, is mounted to the housing assembly 202 and includes a cocking slide 240, a slide link 242, a cradle 244 for abutting and aligning a loaded projectile, a carriage 246, a carriage lock 248, a launch arm 250 having a projectile engagement portion 252 and a cam follower portion 254, FIG. 18, the launch arm 250 being mounted to the carriage 246, FIG. 17, and a launch spring 256. The slide link 242 connects the slide 240 to the cradle 244 and the cradle 244 is connected to the carriage 246, the carriage lock 248 and the launch spring 256. The cradle 244, the carriage 246 and the carriage lock 248 move between a forward position, shown in FIGS. 18 and 19, and a rearward position, shown in FIG. 21. The launch arm 250 is pivotally connected to the carriage 246 and moves between a lowered position, shown in solid lines in FIGS. 17 and 19, and a raised position, shown in phantom lines in FIG. 17 and in solid lines in FIG. 20.

Figure 20:
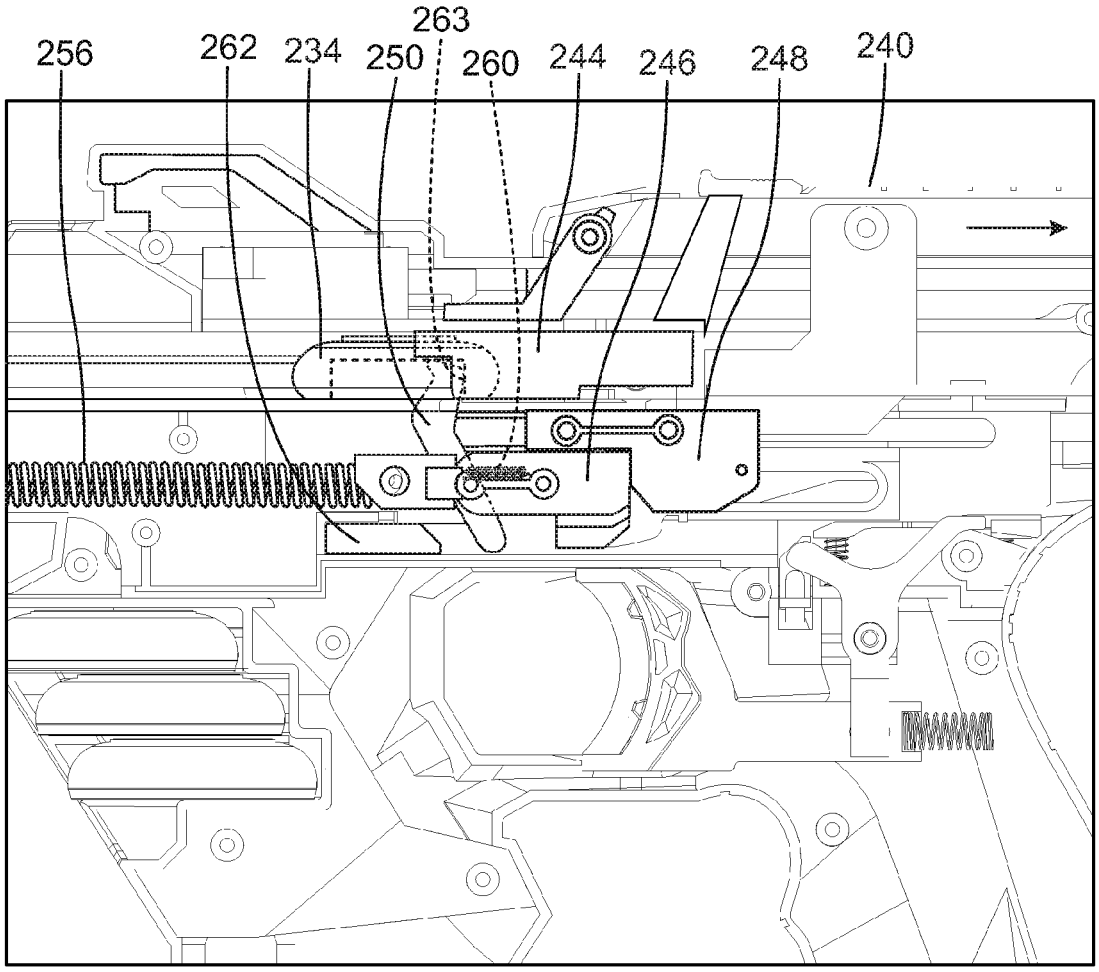
FIG. 20 is an enlarged partial side elevation view of the launch apparatus and projectile shown in FIG. 19, after a cocking cycle has begun and the launch arm is pivoted to a raised position and begins pushing the loaded projectile rearward (to the right in the view).

A small spring 260, FIG. 20, biases the launch arm 250 to the raised position, but when the carriage 246 and the launch arm 250 are in the forward position, a cam 262, FIG. 18, causes the launch arm 250 to pivot to the lowered position by abutting the cam follower portion 254 of the launch arm. When the carriage 246 and cradle 244 are in the forward position the launch arm is in the lowered position to allow a projectile to be loaded through the muzzle 211 and moved rearward to abut the cradle 244. Also, in the lowered position, a projectile may be discharged past the launch arm 250. When the slide is pulled rearward by a user, the launch arm moves away from the cam 262 and pivots to the raised position as shown in FIGS. 20-23. When a user pulls the slide 240 rearward to being cocking the launcher the launch arm 250 moves away from the cam 262, pivots to the raised position, engages the inner wall 88 of the projectile at a rear location 263, FIG. 20, and pushes the projectile rearward. During discharge of the launcher, the launch arm 250 returns forward and engages the inner wall of the projectile at a forward location 264, FIG. 23.

Figure 19:
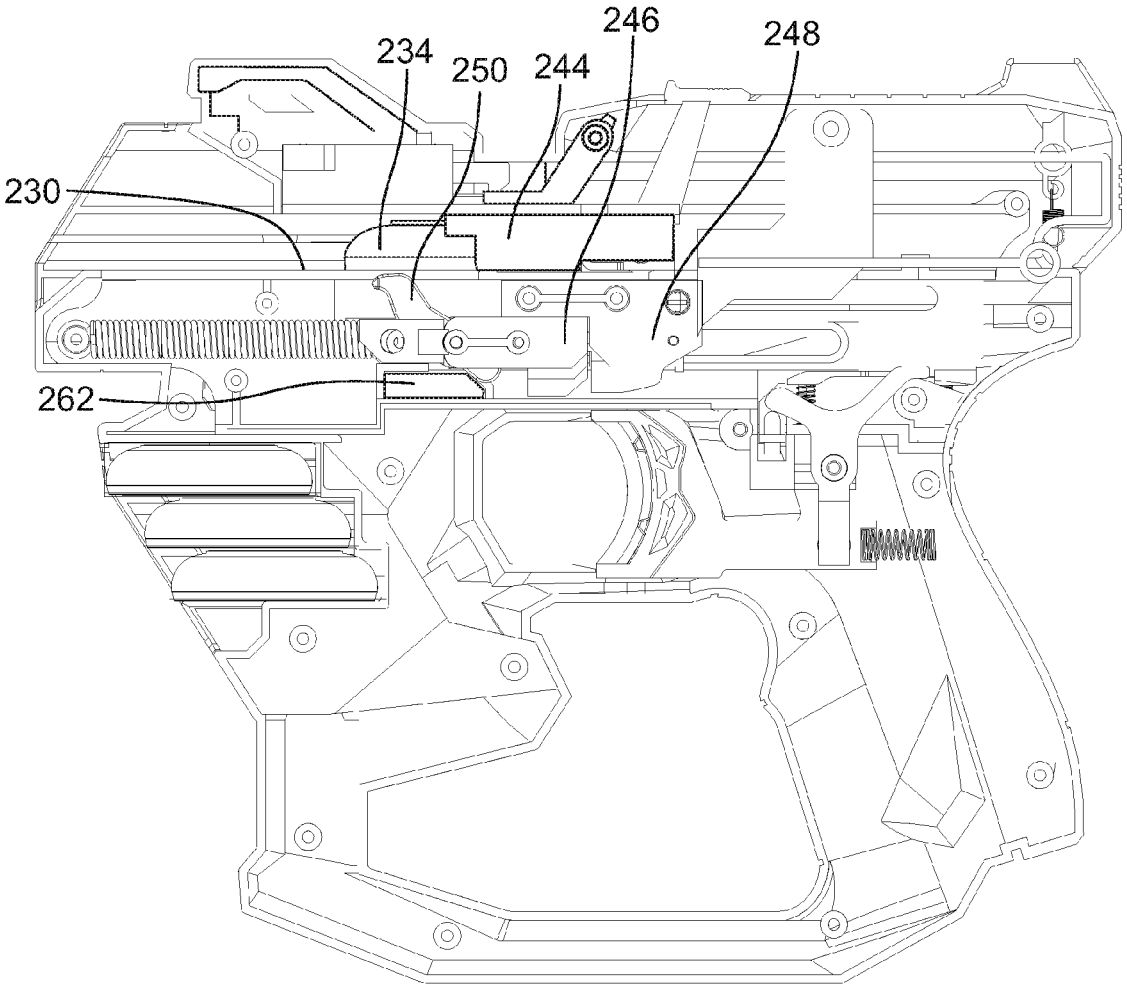
FIG. 19 is a side elevation view of the launch apparatus shown in FIGS. 15-17, with a loaded projectile and a launch arm in a lowered position.
Figure 21:
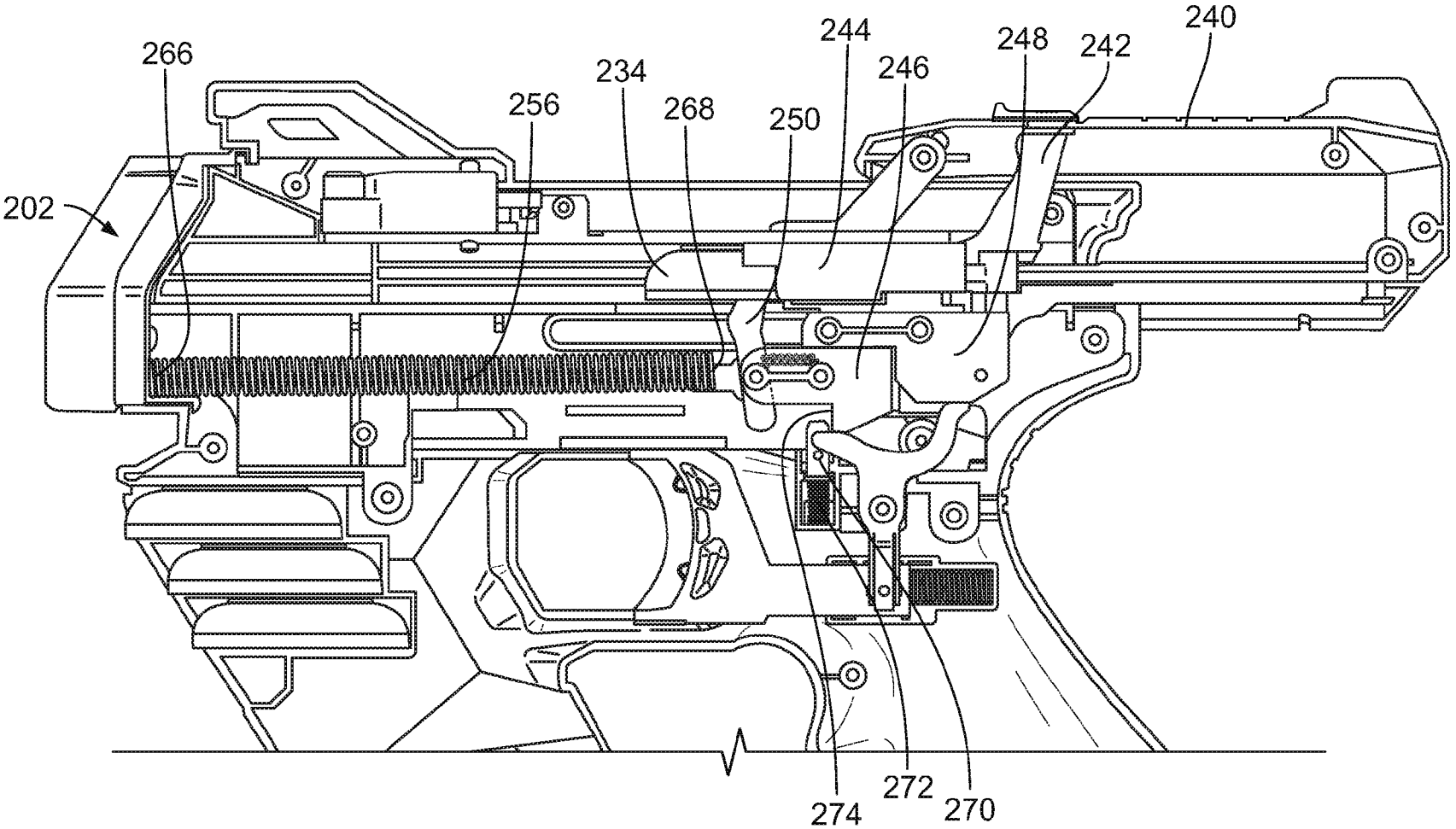
FIG. 21 is a side elevation view of the launch apparatus and projectiles shown in FIGS. 19 and 20, when a first rearward cocking position has been reached.
Figure 22:
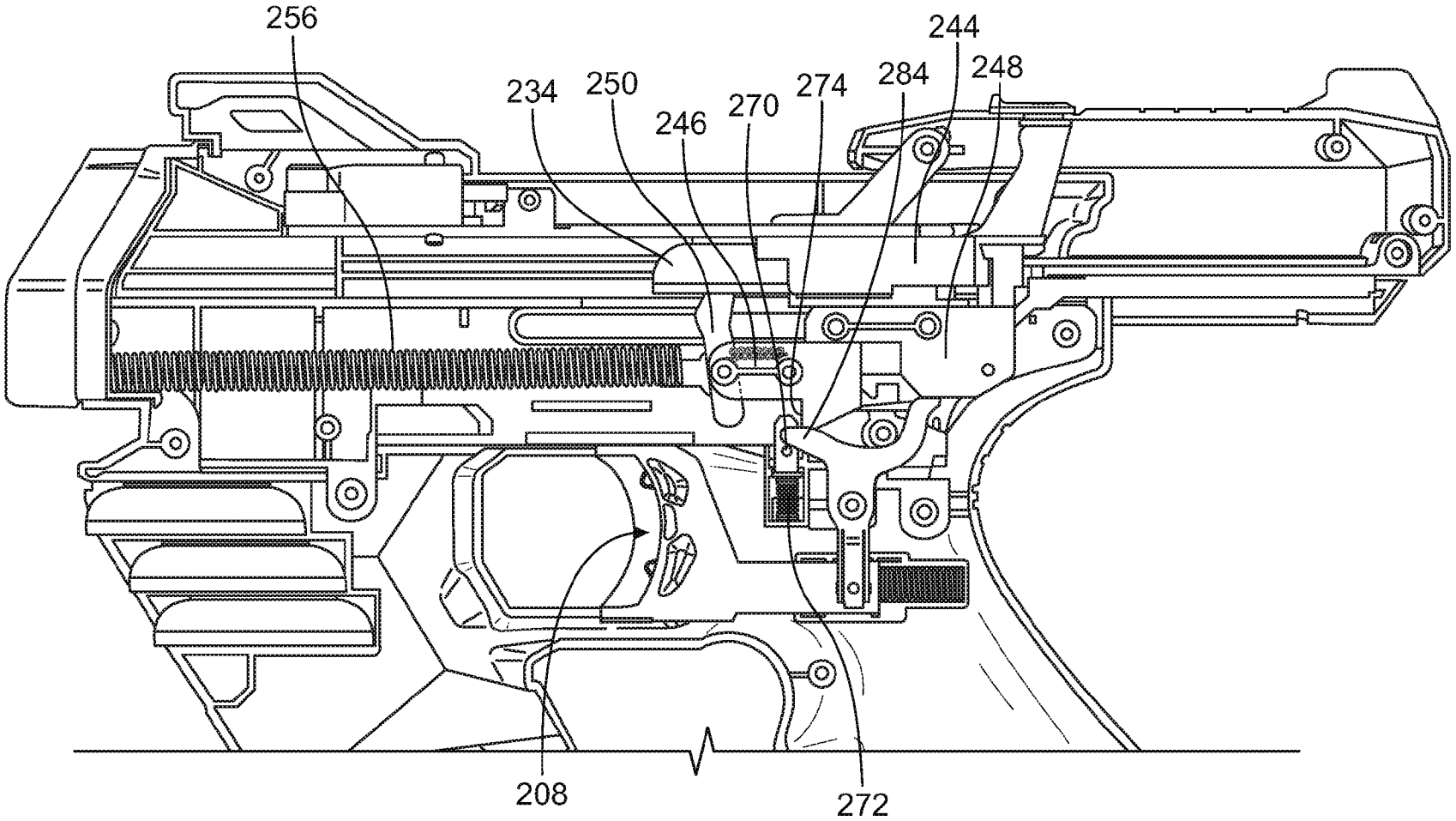
FIG. 22 is a side elevation view of the launch apparatus and projectile shown in FIGS. 19-21, when a second rearward cocking position has been reached.

The launch spring 256 is an extension spring connected at one end 266, FIG. 21, to the housing assembly 202 and at an opposite end 268 to the carriage 246. When the carriage is in the forward position, the launch spring 256 is in a generally relaxed position, as shown in FIGS. 18 and 19. There may be some tension in the spring when in the "relaxed" position without affecting function. As shown in FIGS. 18-21, the carriage lock 248 is attached to the carriage 246 such that when the slide 240 is pulled rearward during the cocking phase to a first rearward position shown in FIG. 21, the cradle 244, the carriage 246 and the carriage lock 248 move as a single unit. When the slide 240 is moved rearward to the first rearward position, the launch spring 256 extends to create a return biasing force that is used to launch the projectile 234. A structure, such as a pin 270, FIG. 21, biased by a spring 272, engages a surface 274 of the carriage 246 to latch the carriage, the launch arm and the launch spring. As the slide 240 is pulled further rearward to a second rearward position shown in FIG. 22, the carriage lock 248 disengages from the carriage 246. The disengagement allows the slide 240, the cradle 244 and the carriage lock 248 to be separated from the carriage 246, the launch arm 250 and the launch spring 256. The separation lowers the mass to be accelerated forward by the launch spring 256 when the carriage 246 is released.

Figure 23:
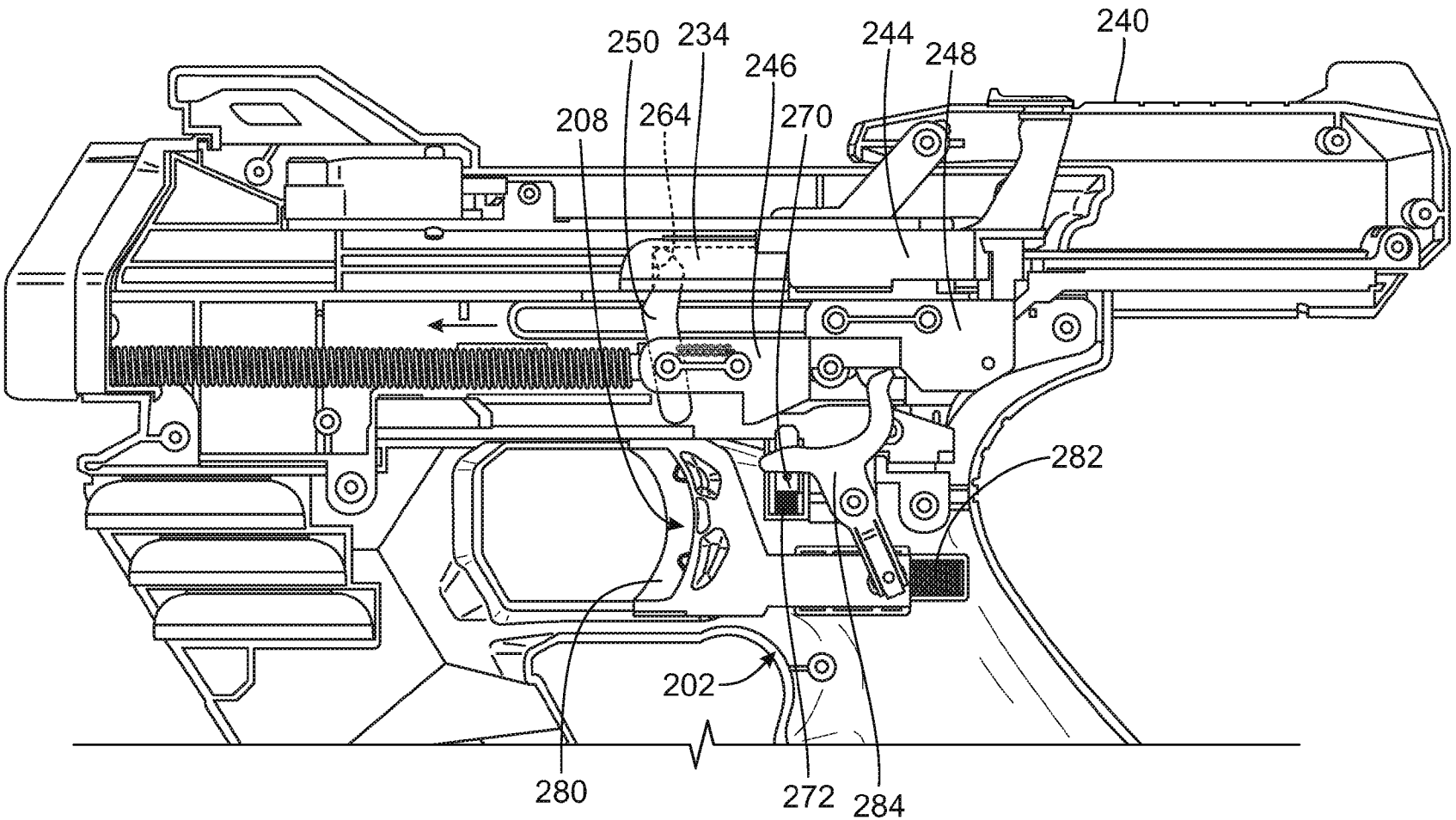
FIG. 23 is a side elevation view of the launch apparatus and projectile shown in FIGS. 19-22, just after a trigger has been pulled.
Figure 24:
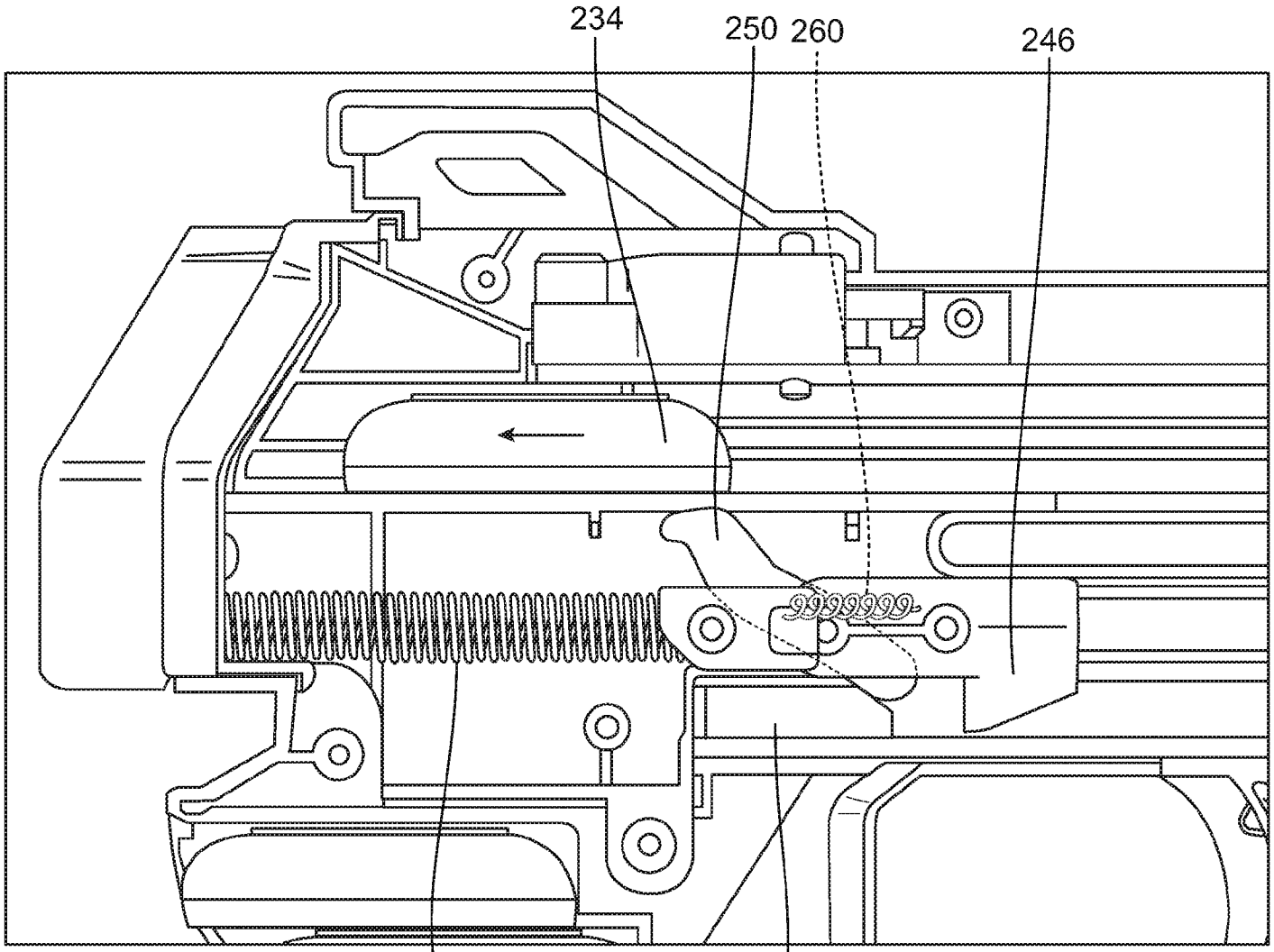
FIG. 24 is an enlarged partial side elevation view of the launch apparatus and projectile shown in FIGS. 19-23, after a cam has pivoted the launch arm to a lowered position and the projectile is being discharged.
Figure 25:
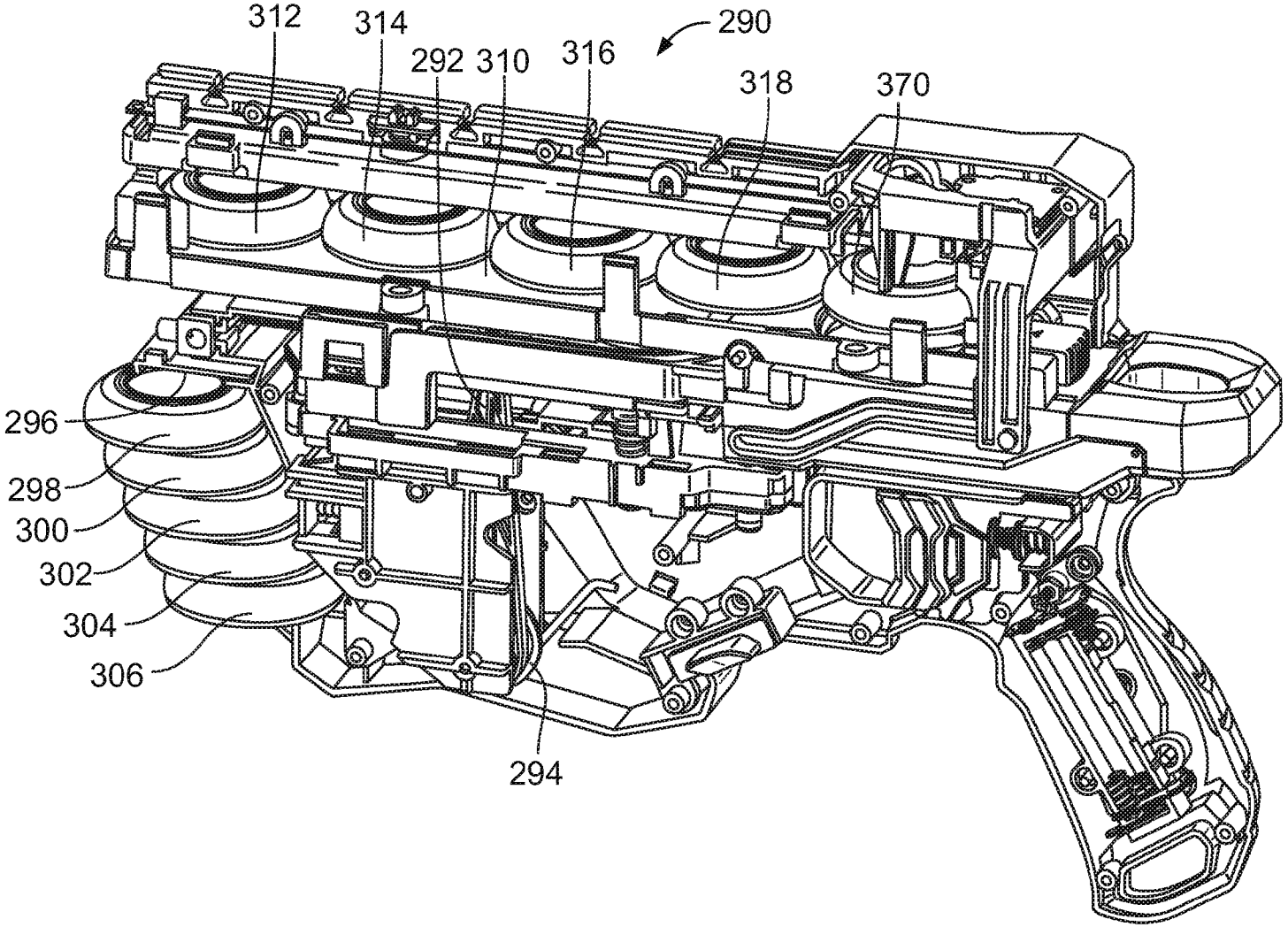
FIG. 25 is a side elevation view of yet another embodiment of the launch apparatus and projectiles where projectiles are stored in an upper portion of a housing apparatus and the projectiles are gravity fed to a launch deck.
Figure 26:
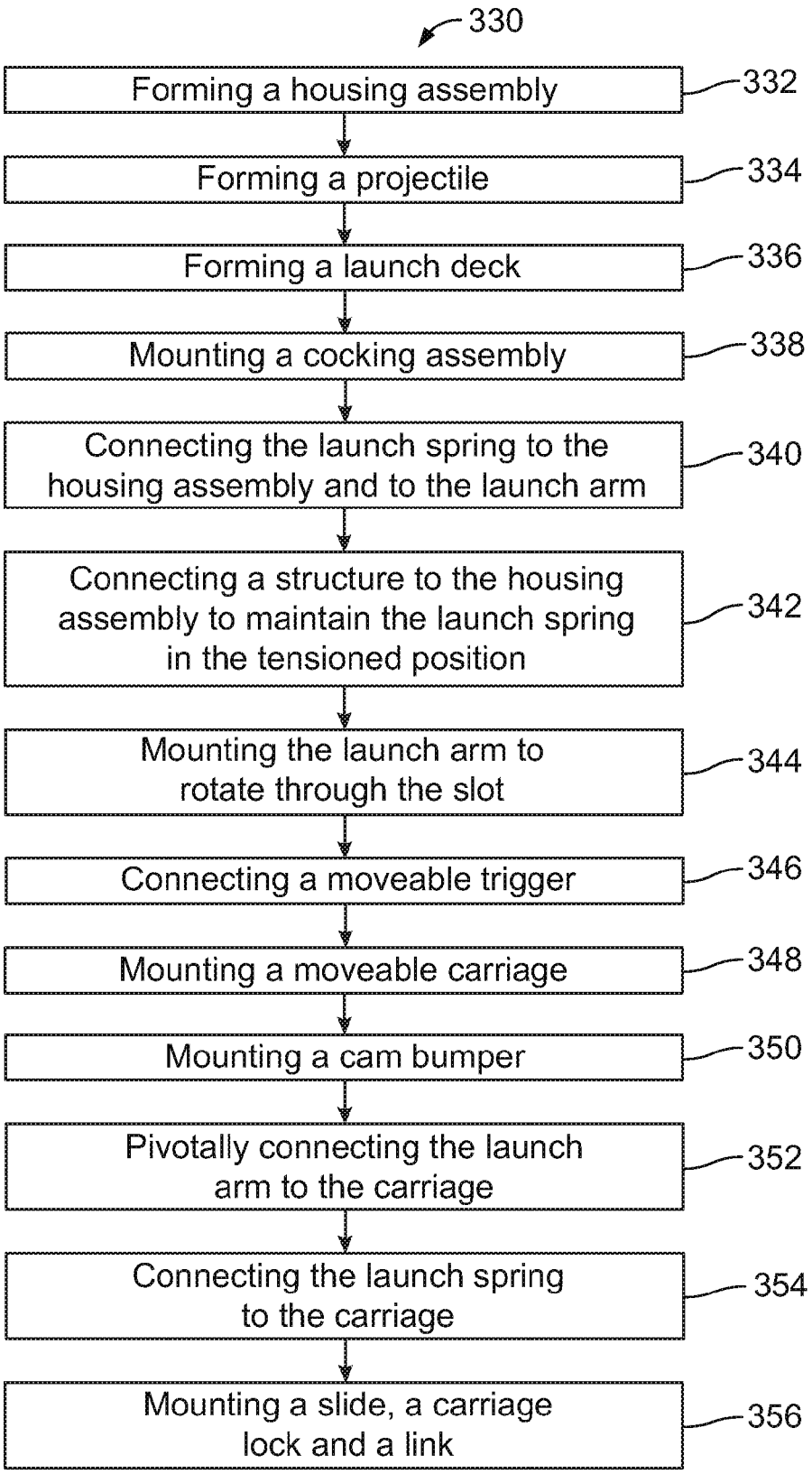
FIG. 26 is a flow diagram for a method of manufacturing the toy launch apparatus and projectile illustrated in FIGS. 15-24.

The trigger assembly 208 is mounted to the housing assembly 202 and includes a trigger pull 280, FIG. 23, a trigger spring 282, and a Y-shaped pivotal link 284. When the trigger pull is pulled rearward by the user, the link 284, connected to the trigger pull, is caused to pivot and depress the pin 270 to release the carriage 246 and allow the carriage 246, launch arm 250 and the projectile 234 to snap forward under the influence of the contracting launch spring 256. When the carriage 246 and launch arm 250 are fully returned forward as shown in FIG. 24, the launch arm 250 impacts the cam 262 which pivots the launch arm 250 to the lowered position. The lowered position of the launch arm allows the projectile, now moving rapidly to the muzzle, to pass and be discharged from the launch apparatus 200. The cam 262 also acts as a bumper to absorb the energy associated with stopping the rapidly moving carriage 246. When the user returns the slide 240 to the forward position, the carriage lock 248 again engages the carriage 246 in anticipation of another cycle of load, cock and discharge of the launch apparatus. With different internal elements (such as shown in FIG. 25) a return spring (not shown) may be connected to the slide and to the housing assembly to cause the slide to automatically return forward when the user releases the slide after cocking the launch spring.

The projectile 12, FIGS. 6 and 7, as mentioned above, includes the soft exterior 84, the open bottom 86 and the inner wall 88 of robust material, such as a hard, strong plastic. The inner wall is engaged by the engagement portion 252 of the launch arm 250 at the rearward location 263, FIG. 20, on the inner wall 88 to draw the projectile rearward when the cocking slide 240 is moved rearward. After cocking, when the trigger pull 280 is pulled, the launch spring 256 moves the carriage 246 quickly forward along with the launch arm 250. The launch arm almost immediately strikes the inner wall 88 at the forward location 264, FIG. 23, and drives the projectile to discharge. When the launch spring 256 returns to the relaxed position, the launch arm 250 pivots to the lowered position to be out of the way of the discharging projectile as shown in FIG. 24. Accordingly the launch apparatus operates with the soft exterior projectile's open bottom and bordering strong inner wall. The projectile's open bottom is positioned atop the slot, with respect to the launch deck and the carriage in the housing assembly. The cocking assembly includes the pivotal launch arm and the launch spring connected to the carriage movable with the engaged slide, slide link and carriage lock, which are cocked when the user pulls the slide rearward. At the first rearward position of the slide the carrier is restrained in a cocked configuration. On the way to the second rearward position of the slide, the slide, slide link and carriage lock disengage from the carriage, launch arm and launch spring. When the carriage and launch arm are triggered, the launch spring releases and the launch arm strikes the inner wall of the projectile for discharge.

The housing assembly may also be shaped differently depending upon different motifs, such as the popular STAR WARS® motif.

In operation, the user loads a projectile manually through the muzzle 211 and into the barrel 210 to abut the cradle 244. At this stage, the launch arm 250 is in the lowered position. Next, the user pulls the slide 240 rearward causing the launch spring 256 to extend, the launch arm 250 to pivot to the raised position, and the projectile to be drawn rearward by the launch arm. The launch arm 250 engages a rear or back location on the inner wall 88 of the projectile to draw the projectile rearward. When the slide 240 is pulled rearward to the first rearward position, the launch spring and the carriage are locked in the cocked position. The cocking phase is complete when the user pulls the slide further back to the second rearward position. Moving to the second rearward position causes the carriage lock, the cradle and the slide to disengage from the carriage and the launch spring. When the user pulls the trigger pull 280, the carriage 246 with the launch arm 250 are released and the launch spring 256 snaps the carriage and launch arm forward along with the projectile. During discharge, the launch arm impacts the front location on the inner wall 88 of the projectile to cause discharge.

Still another embodiment of the present invention is shown in FIG. 25. A launch apparatus 290 having a launch arm 292 like that shown in FIG. 11, with a torsion launch spring 294 includes a forward projectile storage bin 296 like that shown in FIG. 15, except storing five projectile discs 298, 300, 302, 304, 306. The launch apparatus 290 also includes an upper magazine 310 with an additional five projectile discs 312, 314, 316, 318, 320. The upper magazine allows for a gravity-feed of the projectile discs from the magazine 310. Additionally with a further embodiment a light illumination source may be associated with the magazine 310 wherein glow in the dark versions of the projectile discs 298, 300, 302, 304, 306 may be provided to optically charge such projectile discs for light up effects within the magazine 310.

The present invention also includes a method 330 or making a toy launch apparatus and projectile including forming a housing assembly 332, such as the housing assemblies 14, 202, forming a projectile 334 having an open bottom, a soft exterior and a robust inner wall bordering the open bottom, such as the projectile discs 12, 234, forming a launch deck 336 in the housing assembly, the launch deck including a slot for receiving a projectile wherein the slot is beneath the open bottom of the projectile, such as is shown in FIGS. 12 and 19, mounting a cocking assembly 338 to the housing assembly, the cocking assembly including a pivotal launch arm and a launch spring, such as the cocking assemblies 18, 206, the launch arms 100, 250 and the launch springs 108, 256, connecting the launch spring to the housing assembly and to the launch arm 340, the launch spring being movable to a tensioned or extended position, connecting a structure to the housing assembly to maintain the launch spring in the tensioned position 342, such as the catch structure 106, and the pin 270, mounting the launch arm to rotate through the slot 344 between a lowered position and a raised position and through the open bottom of the projectile to impact the interior wall of the projectile, such as shown in FIGS. 11, 19, 20 and 23, and connecting a movable trigger 346 to the housing assembly to cause the structure to release the launch arm. The method may also include mounting a carriage movable 348 in the housing assembly and a cam bumper 350 stationary in the housing assembly, pivotally connecting the launch arm to the carriage 352, the launch arm having a projectile impact portion and cam follower portion, connecting the launch spring to the carriage 354, mounting a slide, a carriage lock and a link 356 to the housing assembly, with the carriage lock being releasably connected to the carriage.

The toy launcher apparatus disclosed in detail above has great play value, is fun to use and easy to operate in a safe manner, even for young children, and yet the launch apparatus has a robust, but simple structure, that may be produced at a reasonable cost. (It is noted that the terms "launcher" and "launch apparatus" are used interchangeably above.)

From the foregoing, it can be seen that there has been provided features for an improved toy launch apparatus and a disclosure for the method of the making the toy. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

a housing assembly;

a launch deck mounted to the housing assembly for receiving a projectile, the launch deck having a slot;

a projectile for being supported on the launch deck over the slot, the projectile having an open bottom, a soft exterior and a robust inner wall bordering the open bottom;

a cocking assembly mounted to the housing assembly, the cocking assembly including a movable carriage with the launch arm is pivotally connected to the carriage and moves between lowered and raised positions and a launch spring connected to the housing assembly and the carriage, the launch arm being movable to engage the inner wall of the projectile; and a trigger mounted to the housing assembly and connected to the carriage to enable the launch spring to be released from a tensioned position and cause the launch arm to strike the hard inner wall of the projectile through the open bottom.

2. The toy launcher apparatus of claim 1, wherein:

the cocking assembly includes a cam; and the launch arm includes a cam follower, with the cam follower configured to interact with the cam of the cocking assembly.

3. The toy launcher apparatus of claim 1, wherein:

the cocking assembly includes a slide mounted to the housing assembly, a carriage lock and a slide link connecting the slide and carriage lock with the carriage configured to interact with the carriage lock.

4. The toy launcher apparatus of claim 1, wherein:

the cocking assembly includes a cradle for abutting the projectile.

5. The toy launcher apparatus of claim 1, further including a cam fixed to the housing, and the launch arm including a projectile contact portion and a cam follower portion.

6. The toy launcher apparatus of claim 5, wherein:

the cocking assembly includes a slide mounted to the housing assembly, a carriage lock and a slide link connecting the slide and carriage lock.

7. The toy launcher apparatus of claim 6, wherein:

the launch arm is in the lowered position when the launch deck receives a projectile and when a projectile is discharged; and the launch arm is in the raised position when the launch spring moves to a tensioned position.

8. The toy launcher apparatus of claim 7, wherein:

the slide, slide link, carriage, and carriage lock are movable between an uncocked position, a cocked position and an unlocking position;

the launch arm is in the raised position when the slide, the slide link, carriage, and the carriage lock are in the cocked and the unlocked positions;

the carriage and the carriage lock are engaged when the slide, the slide link and the carriage lock are in the uncocked and cocked positions and disengaged when the slide, the slide link, carriage, and carriage lock are in the unlocking position.

9. The toy launcher apparatus of claim 8, wherein:

the cocking assembly includes a cradle for abutting the projectile.

10. The toy launcher apparatus of claim 1, wherein:

the launch deck includes a first panel disposed as a top surface of the launch deck and a second panel positioned parallel to and spaced apart from the first panel to enable receipt of a projectile between the first and second panels, and a longitudinal guide wall extending parallel to the slot; and the cocking assembly includes a sliding structure connected to the launch arm for moving the launch arm from the first position to the second position and for positioning a projectile for discharge.

11. The toy launcher apparatus of claim 1, wherein:

the slot is located off center of the supported projectile; and the launch arm moves between a first uncocked position and a second cocked position and makes contact with the projectile as the launch arm moves from the second position to the first position.

12. A toy launcher apparatus comprising:

a housing assembly including a launch deck;

a cocking assembly mounted to the housing assembly;

a movable carriage at the launch deck of a housing assembly, the cocking assembly including the carriage for receiving a projectile for being supported on the carriage, the projectile having an open bottom, a soft exterior and a robust inner wall bordering the open bottom;

a launch spring connected to the housing assembly and connected to the carriage;

a launch arm on the carriage, the launch arm movably mounted being movable to engage the inner wall of the projectile; and a trigger mounted to the housing assembly and connected to the carriage to enable the launch spring to be released from a tensioned position and cause the launch arm to strike the hard inner wall of the projectile through the open bottom.

13. The toy launcher apparatus of claim 12, wherein:

the cocking assembly includes a cam; and the launch arm includes a cam follower, with the cam follower configured to interact with the cam of the cocking assembly.

14. The toy launcher apparatus of claim 12, wherein:

the cocking assembly includes a slide mounted to the housing assembly, a carriage lock and a slide link connecting the slide and carriage lock with the carriage configured to interact with the carriage lock.

15. A toy launcher method comprising:

supporting a moveable carriage at a launch deck of a housing assembly;

providing a carriage for a projectile having an open bottom, a soft exterior and a robust inner wall bordering the open bottom being received at the carriage;

mounting a launch arm to rotate on the carriage between a lowered position and a raised position and through the open bottom of the projectile to impact the inner wall of the projectile;

mounting a cocking assembly to the housing assembly, the cocking assembly including the pivotal launch arm, the carriage and a launch spring, the launch spring being connected to the housing assembly and to the carriage; and maintaining the launch spring for extending to a tensioned position as between the housing assembly and the carriage.

16. The method of claim 15, comprising the step of:

connecting a structure to the housing assembly to maintain the launch spring in the tensioned position; and connecting a movable trigger to the housing assembly to cause the structure to release the carriage.

17. The method of claim 15, wherein the step of:

mounting the launch arm provides a projectile impact portion and cam follower portion at the launch arm; and mounting the cocking assembly includes mounting a slide, the carriage a carriage lock and a slide link to the housing assembly, the carriage lock being releasably connected to the carriage.

18. The method of claim 17, wherein the step of:

mounting the cocking assembly includes mounting the carriage movable in the housing assembly and a cam bumper fixed to the housing assembly.

* * * * *